United States Patent [19]

Raasch et al.

[11] Patent Number: 4,974,718

[45] Date of Patent: Dec. 4, 1990

[54] METHOD AND APPARATUS FOR TRANSPORTING YARN PACKAGES

[75] Inventors: Hans Raasch; Helmut Feuerlohn, both of Monchen-Gladbach, Fed. Rep. of Germany

[73] Assignee: W. Schlafhorst & Co., Monchen-Gladbach, Fed. Rep. of Germany

[21] Appl. No.: 254,564

[22] Filed: Oct. 6, 1988

[30] Foreign Application Priority Data

Oct. 9, 1987 [DE] Fed. Rep. of Germany ..... 3734167
Dec. 12, 1987 [DE] Fed. Rep. of Germany ..... 3742220

[51] Int. Cl.[5] ..... B65G 47/24

[52] U.S. Cl. ..... 198/406; 198/407; 198/399; 193/38; 193/46

[58] Field of Search ..... 198/403, 406, 407, 408, 198/409, 410, 411, 412, 457, 435, 482.1, 484.1, 803.13, 389, 390, 487.1, 525–531, 534, 536, 539, 560, 562, 567, 803.14, 803.15, 466.1; 193/38, 41, 46, 1, 2 R; 414/331, 389, 397, 398; 242/35.5 A

[56] References Cited

U.S. PATENT DOCUMENTS 1,972,489 9/1934 Rideout et al. ..... 198/399
3,946,884 3/1976 Kato et al. ..... 198/803.12 X
4,088,228 5/1978 Vlcek et al. ..... 198/487.1 X
4,223,778 9/1980 Kontz ..... 198/389
4,257,516 3/1981 Ionescu ..... 198/407 X
4,555,215 11/1985 Raasch et al. ..... 242/35.5 A X

FOREIGN PATENT DOCUMENTS 0014439 9/1962 Japan ..... 242/35.5 A
0078716 6/1981 Japan ..... 193/46
0139978 8/1983 Japan ..... 242/35.5 A
0430529 8/1967 Switzerland ..... 242/35.5 A

*Primary Examiner*—H. Grant Skaggs
*Assistant Examiner*—James R. Bidwell
*Attorney, Agent, or Firm*—Shefte, Pinckney & Sawyer

[57] ABSTRACT

A yarn package transferring apparatus having a slide for sliding yarn packages thereon from a yarn processing machine and a vertical endless belt assembly for raising the packages from the bottom of the slide to a conveyor which carries the packages for delivering to a location for further handling. The slide has an apparatus for orienting a predetermined leading or trailing end of the packages entering the slide for sliding thereon and a recess adjacent its lower end for uniformly positioning the packages for receipt by the vertical endless belt. A plurality of inclined platforms regularly spaced along the vertical endless belt translationally carry the packages to a package stripper which removes the supported packages from the platforms and loads the packages onto the conveyor.

14 Claims, 3 Drawing Sheets

METHOD AND APPARATUS FOR TRANSPORTING YARN PACKAGES

BACKGROUND OF THE INVENTION

The present invention relates to a method and apparatus for transferring yarn packages exiting the transport assembly of a yarn processing machine and, more particularly, to a method and apparatus for orienting yarn packages for sliding movement, sliding the packages to a removal position and transferring the packages therefrom to a location for further handling.

Typically, yarn packages from winding machines, rotor spinning machines and double twist machines are transported to a central package packing station and, for such transportation, the yarn packages are carried on their side by belts running the length of the machines which carry the packages to the end of the machines. Another transport apparatus then transports the yarn packages from the end of the machines to another location for further handling.

The transport apparatus which transports the yarn packages to the new location is typically at a height sufficient to permit persons to walk freely underneath. Accordingly, the yarn packages collected at the end of the machine must be raised to the transport apparatus and a vertical conveyor or other lift-type apparatus to accomplish such raising of the yarn packages has been proposed, for example, in German Patent No. 33 34 977. The apparatus disclosed therein includes hooks on an endless belt on which the cores of full packages are inserted. A mechanism raises each full package to a position adjacent the endless belt in which the next available hook moves into the package core as it travels by the mechanism. However, the degree and complexity of the components for such a system are relatively burdensome and difficulties easily arise if the raising mechanism is not exactly synchronized with the hooks and if the packages are not precisely delivered to the proper height at which the hooks can engage and remove them from the lift mechanism.

SUMMARY OF THE INVENTION

The present invention therefore provides a simple and reliable method for transferring yarn packages from the transport assembly of the yarn processing machine to an assembly for delivering the packages to a location for further handling. The present invention also provides an appaaratus for transferring yarn packages which requires only minimal space, is simple in construction and which provides an effective transfer of the packages.

Briefly described, the present invention provides a method for transferring yarn packages exiting a transport assembly of a yarn processing machine to an assembly for delivering the packages to a location for further handling. The method includes the steps of orienting the yarn packages exiting the transport assembly of the yarn processing machine in an orientation for sliding movement and sliding the oriented yarn packages along the slide to a removal position. The method also includes the steps of removing the yarn packages from the slide at the removal position and transferring the removed yarn packages to the delivering assembly. According to one feature of the preferred embodiment of the present invention, the step of orienting the yarn packages includes orienting the packages for sliding on their ends and the step of removing and transferring the packages includes removing and transferring the yarn packages in their end orientation. In another aspect of the preferred embodiment of the present invention, the step of orienting the packages includes orienting conical yarn packages for sliding on their wide ends.

The present invention also provides, in one preferred embodiment, an apparatus for transferring yarn packages exiting a transport assembly of a yarn processing machine to an assembly for delivering the packages to a location for further handling. The apparatus includes means for orienting the yarn packages exiting the transport assembly of the yarn processing machine in an orientation for sliding movement, a slide, means for sliding the oriented yarn packages along the slide to a removal position thereon and means for removing the yarn packages from the slide at the removal position and transferring the removed yarn packages to the delivering assembly. In one aspect of the preferred embodiment, the means for orienting the yarn packages includes means for orienting packages for sliding on ends thereof and the means for removing and transferring the yarn packages comprises means for removing and transferring the yarn packages in their end orientation.

In another aspect of the preferred embodiment, the means for orienting the yarn packages includes a yieldable package restraining member. According to one modification of this aspect of the preferred embodiment, the yieldable package restraining member is pivotally mounted above the path of the exiting yarn packages and above said slide for yieldably pivoting to orient the yarn packages for sliding movement on the ends thereof that are trailing in exiting the transport assembly. In another modification of the preferred embodiment, the yieldable package restraining member is pivotally mounted below the path of the exiting yarn packages and below the slide for yieldably pivoting to orient the yarn packages for sliding movement on the ends thereof that are leading in exiting the transport assembly.

According to another aspect of the preferred embodiment, the slide includes shoulders defining a recess therebetween adjacent the lower end of the slide for guiding therein the projecting end of the core of the yarn packages sliding on the slide to thereby position to packages for engagement by the removing and transferring means.

In yet another aspect of the preferred embodiment, the means for removing and transferring the yarn packages includes an endless belt, a plurality of uniformly spaced support members mounted thereon for supporting packages thereon and means for moving the endless belt past the slide for supporting engagement of yarn packages by the support members. In one modification of this aspect of the preferred embodiment, the support members include an open slot for receiving the projecting extent of the core of the yarn package supported thereon and the means for removing and transferring includes means for maintaining the support members and the yarn packages thereon in a predetermined orientation for translational movement thereof during movement of the endless belt.

The method and apparatus of the present invention advantageously ensures that the yarn packages do not collide with one another during their travel on the slide and the vertical transport assembly. Also, the yieldable package restraining member ensures that the packages do not tumble as they travel along the slide.

DETAILED DESCRIPTION OF THE PREFERRED EMBODIMENTS

Figure 1:
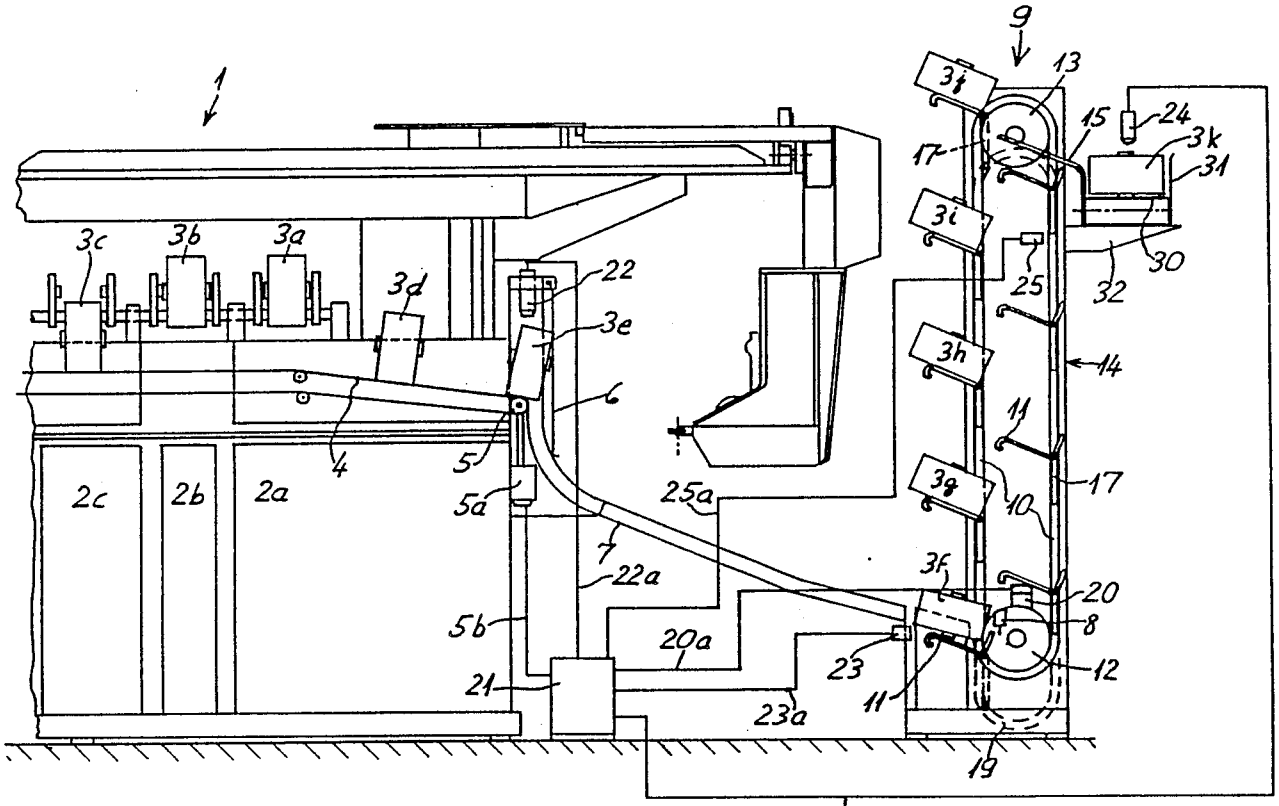
FIG. 1 is a side elevational view of one preferred embodiment of the transfer apparatus of the present invention, showing a number of packages at different locations along the apparatus as they are transported from the longitudinal conveyor of a winding machine to a conveyor which carries the packages to a further processing or packaging station.

As shown in FIG. 1, a textile winding machine 1 having individual winding stations 2*a*, 2*b* and 2*c* produces finished yarn packages, of which packages 3*a* and 3*b* are shown immediately after the completion of the winding of yarn thereon, package 3*c* is being loaded onto the transport assembly of a yarn processing machine, which in this case is a longitudinal conveyor 4 running the length of the winding machine for delivering the finished packages to one end thereof and a package 3*d* is a package transported by the longitudinal conveyor 4 from its winding station toward the end of the machine.

The transfer apparatus of the present invention includes a slide orienting assembly 6 adjacent the longitudinal conveyor 4 at the point where the conveyor reverses direction around a roller 5, a slide assembly 7 extending downwardly from adjacent the end of the conveyor 4 to a removal position spaced from and lower than the conveyor end at which a removal and transfer means for removing and transferring the packages to the delivering assembly, such as vertical assembly 9 having a stop bar 8, raises the packages to the delivering assembly, such as a lateral conveyor 30 which also services several other textile winding machines. A package 3*e* is shown as it contacts the slide orienting assembly 6 immediately prior to sliding down the slide 7 to the vertical assembly 9. The slide orienting assembly 6 includes a yieldable package restraining member such as a hinged vertical flap against which the leading ends of each exiting package moves in sliding contact as the package exits the longitudinal conveyor 4 onto the slide assembly 7 and the flap pivots as it yields to the package sliding against it in such a manner that the package is prevented from tumbling as it enters the slide assembly 7 and is tilted so as to be oriented for sliding movement on its end that is trailing as it exits the conveyor 4.

The vertical assembly 9 includes an endless belt 10 traveling vertically in a clockwise direction and having a plurality of U-shaped, inclined support members or platforms 11 coupled thereto at spaced intervals. The endless belt 10 is supported and driven at its lower end by a roller 12 and supported at its upper end by a roller 13, which rollers are mounted in a frame 14. The vertical assembly 9 also includes a package stripper 15 positioned adjacent the upper end of the endless belt 10 and compatibly configured to cooperate with the platforms 11 to engage the underside of the packages thereon as the platforms move past the stripper. The stripper 15 is downwardly inclined toward the lateral conveyor to slide the packages onto the lateral conveyor 30 while maintaining the packages in the same orientation that they are transported in on the platforms 11. For example, a package 3*k* is shown immediately after sliding onto the conveyor. The conveyor 30 then transports the packages, along a height sufficiently above the floor to allow passage of persons thereunder, to further processing or packaging stations. The conveyor 30 includes an outer longitudinal wall 31 which guides the packages during their transport by the conveyor and the conveyor is supported by an arm 32 projecting from the frame 14 of the vertical assembly 9.

Figure 2:
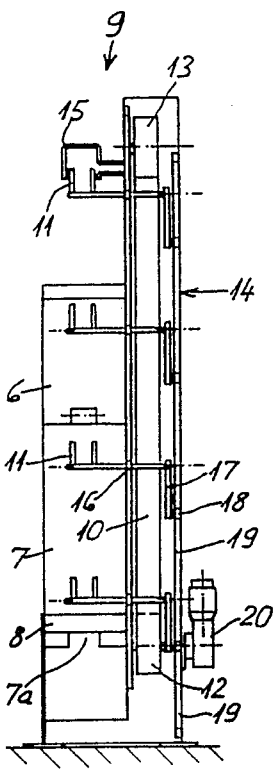
FIG. 2 is an end elevational view of the vertical assembly of the transfer apparatus of FIG. 1, showing the orientation maintaining assembly for maintaining the orientation of the packages transported by the vertical assembly.

As seen in FIG. 2, the platforms 11 are rotatably coupled to the endless belt 10 by a plurality of hubs 16 spaced along the belt which rotatably secure cylindrical arms of the platforms projecting therein. The free axial end of each cylindrical arm of platforms 11 projects laterally beyond its respective hub 16 and is coupled to one end of a lever 17 having a guide roller 18 guided in a track 19 at its other end. The track 19 is of a shape identical to the shape of the endless belt 10 and is parallel to but downwardly offset from the endless belt 10. Since the rollers 18 travel along the track 19 in identical yet vertically offset path with respect to the platforms 11, the platforms are maintained in the same orientation with respect to the endless belt 10 during their travel circuit and the packages thereon are translationally moved from the removal position on the slide assembly 7 to the stripper 15. As seen in FIG. 1, the predetermined orientation of the platforms 11 is preferably at an inclination parallel to the inclination of the lower portion of the slide assembly 7 so that packages exiting the slide assembly 7 slide smoothly onto the platforms 11.

Figure 3:
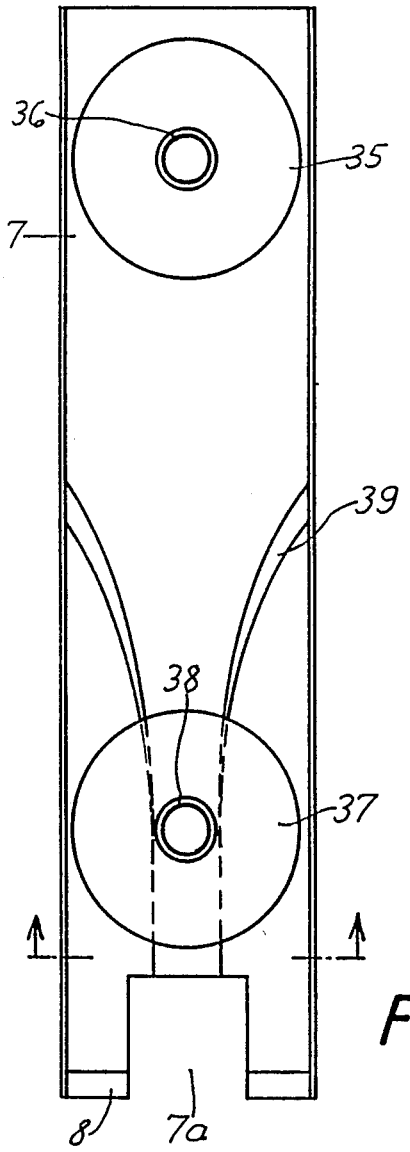
FIG. 3 is an end elevational view of the lower portion of the slide assembly of the transfer apparatus of FIG. 1, showing a package traveling through the centering apparatus for uniformly positioning the packages for engagement by the platforms of the vertical assembly.
Figure 4:
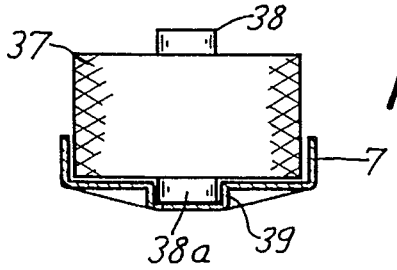
FIG. 4 is a vertical sectional view of the lower portion of the slide assembly in FIG. 3 taken in the direction of the arrows in FIG. 3, showing the package traveling through the centering apparatus including the positions of the lower axial end of the package core and the sliding suface of the package relative to the surface of the centering apparatus.

As seen in FIG. 3, the slide assembly 7 includes an apparatus for centering the packages with respect to the longitudinal axis of the slide assembly as they approach the stop bar 8. The centering apparatus includes a recess 39 defined by a pair of longitudinal shoulders in the floor of the slide assembly 7 which tapers to an axially centered, longitudinal trough in the direction of an axially centered slot 7*a* formed at the end of the slide assembly 7. The recess 39 is designed to center an oncoming package, such as the package 35 having a core 36 illustrated in FIG. 3, so that the packages exiting the slide assembly are uniformly disposed in a predetermined position as they reach the removal position to be received on the platforms 11. The recess 39 directs the projecting end of the cores of the oncoming packages sliding on the slide assembly 7, such as the core 38 of a package 37 illustrated in FIG. 3, into and along its longitudinal recess. As seen in FIG. 4, the recess is of a width to permit non-binding yet controlled passage therethrough of the core 38. Additionally, the depth of the recess is less than the extent of the projecting portion 38*a* of the core 38 which projects beyond the wound yarn so that the packages slide along the ends of their cores through the longitudinal recess without the surface of their wound yarn which faces the slide assembly 7 being in sliding contact therewith. As a package slides along the longitudinal recess, a platform 11 moves upward through the slot 7*a* to receive the oncoming package.

The transfer apparatus of the present invention additionally includes a plurality of sensors 22, 23 and 24, coupled to a common control apparatus 21 by feeds 22*a*, 23*a* and 24*a*, respectively, for providing information to the control apparatus 21 for coordinating the transport of the packages. In response to the information relayed to it by the sensors 22, 23 and 24, the control apparatus 21 controls the operation of a motor 5*a*, which rotates the roller 5 to drive the longitudinal conveyor 4, and a motor 20 which drives the roller 12 of the vertical assembly 9. Connectors 5*b* and 20*a* connect the control apparatus 21 to the motors 5*a* and 20, respectively.

The operation of the sensors 22, 23 and 24 and the control apparatus 21 to control the movement of the packages through the transport apparatus in measured fashion is as follows. The sensor 22, which is sufficiently above the roller 5 to allow passage of a package thereunder, registers the arrival of a package at the end of the longitudinal conveyor 4, such as, for example, the package 3*e* illustrated in FIG. 1, and relays a signal through the lead 22*a* to the control apparatus 21. In similar fashion, the sensor 23, which is positioned below the lower end of the slide assembly 7, registers the passage of a package passing thereover from the slide assembly 7 to a platform 11 such as, for example, the package 3*f* illustrated in FIG. 1, and relays a signal through the lead 23*a* to the control apparatus 21. Accordingly, when the control apparatus 21 receives a signal from the sensor 23 that a package has arrived at the end of the slide assembly 7, the control apparatus transmits a control signal through the connector 5*b* to the motor 5*a* to stop the operation of the longitudinal conveyor 4 so that no further packages are loaded onto the slide assembly 7, thereby preventing two packages from simultaneously sliding on the slide assembly 7 which could lead to detrimental contact therebetween.

Throughout the operation of the sensors 22 and 23, the sensor 24, which is positioned above the conveyor 30 at the location at which the packages 11 slide from the package stripper 15 onto the conveyor, signals the control apparatus 21 whenever the conveyor 30 has free space to accept further packages. In response to the signals from the sensor 24, the control apparatus 21 controls the operation of the motor 20 to operate the endless belt 10 to move another platform 11, with a package supported thereon, through the package stripper 15 as well as to move another platform 11 into position to receive the package exiting the slide assembly 7. Thereafter, the motor 5*a* is controlled to again drive the longitudinal conveyor 4 to deliver another package against the vertical flap of the slide orientation apparatus 6 to begin its journey down the slide assembly 7.

Additionally, a position sensor 25, positioned below the package stripper 15 and adjacent the endless belt 10 and connected via a lead 25*a* to the control apparatus 21, is contacted by the lever 17 of the platforms 11 passing thereby. If the control apparatus, following receipt of the signal from the position sensor 25, also receives a signal from the sensor 23 that another package has been loaded onto a platform 11, the control apparatus continues the operation of the endless belt 10 to deliver the newly loaded package to the conveyor 30. Otherwise, the control apparatus 21 stops the operation of the endless belt 10.

It should be noted that the transport apparatus of the present invention can be adapted for use with double sided spinning and winding machines having a pair of longitudinal conveyors for clearing finished packages from each side. However, if the packages produced by such double sided machines are conical packages, it is preferable that the packages be positioned on the longitudinal conveyors of the machine such that the packages rest on their sloping yarn surfaces. Additionally, it is preferable that the conical packages being fed to the transport apparatus of the present invention by the pair of longitudinal conveyors be oriented such that the same respective core ends of each package face in the same direction.

Figure 5:
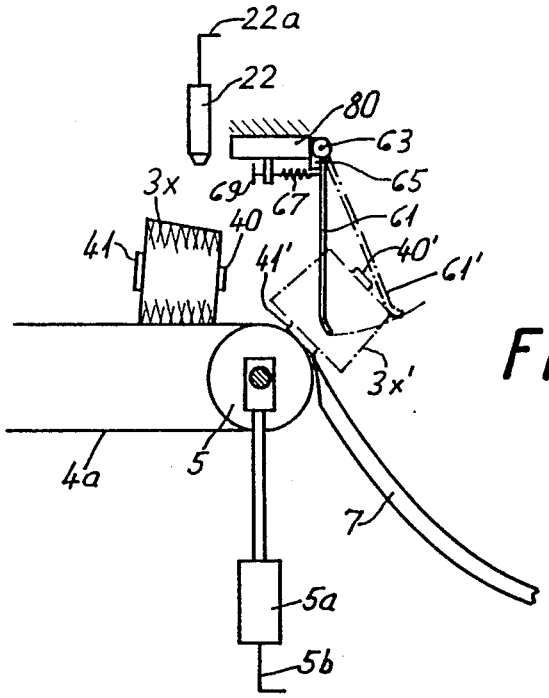
FIG. 5 is a side elevational view of another preferred embodiment of the transfer apparatus of the present invention, showing the orientation of a package prior to and immediately after entering the slide assembly of the transport apparatus including the engagement of the package by a slide orienting assembly.
Figure 6:
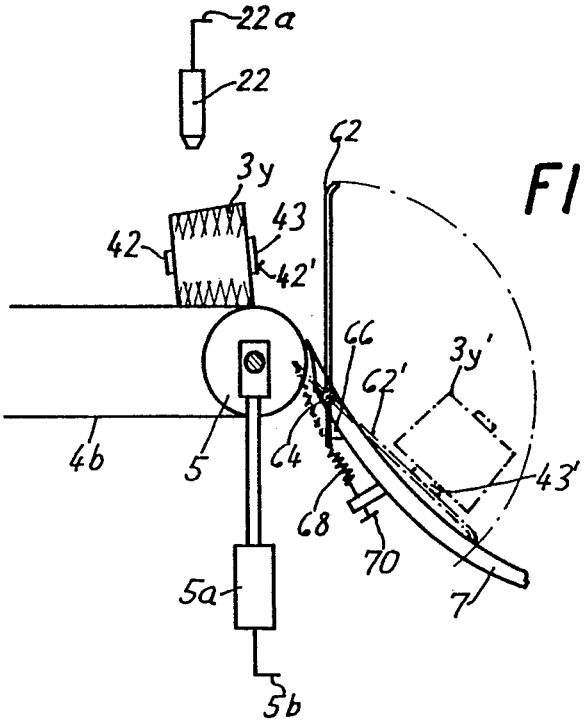
FIG. 6 is a side elevational view of another preferred embodiment of the transfer apparatus of the present invention, showing the orientation of a package with respect to the slide assembly prior to and immediately after the package is engaged by the slide orienting assembly.

As shown in the two modifications of the preferred embodiment respectively illustrated in FIGS. 5 and 6, the transport apparatus of the present invention can be adapted to properly orient the packages entering the slide assembly 7 so that the packages slide on the core end projecting from the wide end of the conically wound yarn, irrespective of which end of the core of the packages is the leading end during travel on the conveyor 4. In the embodiment of FIG. 5, the package is oriented so that the end that is trailing on the conveyor 4 is oriented as the bottom for sliding on the slide assembly 7. A conical package 3*x* is transported from a winding station by a textile winding machine conveyor 4*a* and has the core end 40 adjacent the narrow portion of its conically wound yarn as its leading end and the other core end 41 as its trailing end. The conveyor 4*a* delivers packages from one side of a double sided spinning or winding machine. To properly orient the package 3*x* so that it slides down the slide assembly 7 on its core end 41, a flap 61 is provided. The flap 61 is pivotably coupled to a holder 80 for pivoting about an axis 63 above the slide assembly 7 and above the path of the package. A pivot stop bar 65 is mounted to one end of the holder 80. An apparatus for yieldably urging the flap 61 against the stop bar 65 in position for engagement of yarn packages, such as a spring 67, is coupled at one end to the flap 61 and secured adjacent its other end to the holder 80 and has an adjustment mechanism 69 for adjusting the tension thereof.

The operation of the flap 61 to orient the package 3*x* is as follows. As the core end 40 of the package is moved against the flap by operation of the longitudinal conveyor 4*a* (which is activated by the control apparatus 21), the flap pivots about its axis 63 with a degree of resistance controlled by adjustment of the spring 67 through its adjustment mechanism 69. Specifically, the resistance is adjusted so that the package 3*x* is prevented from tumbling as it enters the slide assembly 7 and is caused to pivot to assume the position 3*x*′ in which its originally trailing end becomes the bottom 41' for sliding on the slider assembly 7. The flap 61 is pivoted outward to the position 61' as the package enters the slide assembly and, as the package exits the flap 61 and slides down the slide assembly 7, the flap is automatically returned to its vertical position by the action of the spring 67 which pulls the flap 61 against the pivot stop bar 65.

As shown in FIG. 6, the preferred embodiment can also be modified to properly orient packages arriving at the slide assembly 7 with their core ends adjacent the wide portion of the wound yarn as their leading ends. Thus, a conical package 3*y* on the conveyor has its wide end 43 as its leading end and its small end 42 as its trailing end. The slide orienting apparatus 6 includes a flap 62 pivotally connected to the slide assembly 7 to pivot about an axis 64 below the adjacent end of the slide assembly 7. A spring 68 is coupled at one end to the lower end of the flap 62 and is mounted adjacent its other end to the underside of the slide assembly 7 to normally urge the flap 62 in an upright position in the path of the packages exiting the conveyor 4*b* yieldably against a stop bar 66. An adjustment mechanism 70 controls the tension of the spring 68.

In operation of the embodiment of FIG. 6, the sensor 22*a* senses the arrival of the package 3*y* and transmits this information over the lead 22*a* to the control apparatus 21. If the control apparatus 21 has received a signal from the sensor 23 that no packages are at the bottom of the slide assembly 7*a*, the control apparatus 21 activates the motor 5*a* to rotate the roller 5 whereby the package 3*y* is conveyed by the conveyor 4*b* against the flap 62. In response to the movement and weight of the package 3*y* against it, the flap 62 pivots clockwise about its axis 64 to the position designated 62', from which the package slides onto the slide assembly 7 with its wide end 43 now at the bottom, as indicated at 3*y'*. Once the package is clear of the flap 62, the flap automatically returns to its initial vertical position against the stop bar 66 by the action of the spring 68.

If the packages are delivered to the slide assembly 7 in mixed orientation with some of the packages having their wide ends facing the direction of travel and other packages having their small ends facing the direction of travel, the transport apparatus of the present invention can be provided with both flaps 61 and 62 and their respective hardware as well as with a conventionally known apparatus for activating the appropriate flap for engaging each type of oncoming package.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. Apparatus for transferring yarn packages exiting a transport assembly of a yarn processing machine to an assembly for delivering the packages to a location for further handling, each yarn package being of the type having a wide end and a small end of relatively smaller diameter than its wide end, comprising:

means for orienting those yarn packages having the same selected one of their wide and small ends in a leading position relative to the direction of transport for sliding on ends thereof;

a slide having shoulders defining a recess therebetween adjacent the lower end of the slide for guiding therein the projecting end of the core of a yarn package sliding on said slide to thereby position the packages at a removal position for removal from said slide, said slide being inclined toward the removal position; and means for removing the yarn packages in their end orientation from said slide at the removal position and transferring the removed yarn packages to the delivering assembly.

2. Apparatus for transferring yarn packages exiting a transport assembly of a yarn processing machine to an assembly for delivering the packages to a location for further handling, each yarn package being of the type having a wide end and a small end of relatively smaller diameter than its wide end, comprising:

means for orienting those yarn packages having the same selected one of their wide and small ends in a leading position relative to the direction of transport for sliding movement;

a slide inclined toward a removal position at which yarn packages are removed from said slide; and means for removing yarn packages from said slide at the removal position and transferring the removed yarn packages to the delivering assembly, said means for removing and transferring the yarn packages including an endless belt, a plurality of uniformly spaced support members mounted thereon for support of packages thereon, said slide including an open slot for receiving the projecting extent of the core of a yarn package supported on said slide, means for moving said endless belt past said slot for supporting engagement of yarn packages by said support members and means for maintaining said support members and the yarn packages supported thereon in a predetermined orientation for translational movement thereof during movement of said endless belt.

3. Appartus for transferring yarn packages according to claim 1 and characterized further in that the means for orienting the packages comprises means for orienting conical packages for sliding on their wide ends.

4. Apparatus for transferring yarn packages according to claim 3 and characterized further in that said slide is downwardly inclined in the direction of the removal position for sliding of oriented packages downwardly therealong to the removal position.

5. Apparatus for transferring yarn packages according to claim 1 and characterized further in that said means for orienting the yarn packages includes a yieldable package restraining member positioned generally transverse to the direction of travel of the yarn packages exiting the transport assembly of the yarn processing machine for yieldable engagement of yarn packages to cause orientation of the packages by said yieldable engagement.

6. Apparatus for transferring yarn packages according to claim 5 and characterized further in that said yieldable package restraining member yieldably engages the leading end of each exiting package.

7. Apparatus for transferring yarn packages according to claim 6 and characterized further in that said yieldable package restraining member is pivotably mounted above the path of exiting yarn packages and above said slide for yieldable pivoting to orient the yarn packages for sliding movement on the ends thereof that are trailing in exiting the transport assembly.

8. Apparatus for transferring yarn packages according to claim 6 and characterized further in that said yieldable package restraining member is pivotably mounted below the path of exiting yarn packages and below said slide for yieldable pivoting to orient the yarn packages for sliding movement on the ends thereof that are leading in exiting the transport assembly.

9. Apparatus for transferring yarn packages according to claims 5, 6, 7 or 8 and characterized further by means for yieldably urging said yieldable package restraining member in its position for engagement of yarn packages.

10. Apparatus for transferring yarn packages according to claim 1 and characterized further in that the depth of the recess is less than the extent of projection of the cores of the packages sliding therethrough.

11. Apparatus for transferring yarn packages according to claim 1 and characterized further in that said means for removing and transferring the yarn packages includes an endless belt, a plurality of uniformly spaced support members mounted thereon for support of packages thereon and means for moving said endless belt past said slide for supporting engagement of yarn packages by said support members.

12. Apparatus for transferring yarn packages according to claim 2 and characterized further in that said means for removing and transferring includes means for transferring yarn packages from said endless belt onto said delivering assembly in said predetermined orientation.

13. Apparatus for transferring yarn packages according to claim 2 and characterized further in that said slide includes an open slot contiguous with the slot of the support members for engagement and removal of yarn packages at said removal position.

14. Apparatus for transferring yarn packages according to claim 2 and characterized further by a control apparatus for controlling the means for orienting, the means for sliding, and the means for removing and transferring.

* * * * *